US005896796A

United States Patent [19]

Chih

[11] Patent Number: 5,896,796

[45] Date of Patent: Apr. 27, 1999

[54] DEVICE FOR PUNCHING HOLES IN A BICYCLE RIM

[76] Inventor: Chen-Keng Chih, 6F-2, No. 57, Hsuehfu Rd., Taichung, Taiwan

[21] Appl. No.: 08/869,520

[22] Filed: Jun. 6, 1997

[51] Int. Cl.[6] ..... B26F 1/14; B26D 7/26

[52] U.S. Cl. ..... 83/181; 83/193; 83/582; 83/615; 83/639.1; 83/687

[58] Field of Search ..... 83/180, 192, 193, 83/194, 615, 621, 635, 639.1, 639.5, 687, 54, 109, 181, 188, 191, 582, 588, 378, 382

[56] References Cited

U.S. PATENT DOCUMENTS

| | | | |
|---|---|---|---|
| Re. 33,798 | 1/1992 | Waltonen | 83/639.1 X |
| Re. 34,621 | 5/1994 | Waltonen et al. | 83/193 X |
| 466,823 | 1/1892 | Gendron | 83/193 X |
| 1,419,619 | 6/1922 | Edwards et al. | 83/639.1 X |
| 1,503,551 | 8/1924 | Nice | 83/193 X |
| 1,581,810 | 4/1926 | Patrick | 83/193 X |
| 2,374,301 | 4/1945 | Olney | 83/194 X |
| 4,098,161 | 7/1978 | Bloch | 83/639.1 X |
| 5,054,305 | 10/1991 | Obrecht et al. | 83/615 X |
| 5,640,877 | 6/1997 | Danly, Sr. | 83/639.5 X |
| 5,699,708 | 12/1997 | Deni et al. | 83/687 X |

*Primary Examiner*—Clark F. Dexter
*Attorney, Agent, or Firm*—William E. Pelton

[57] ABSTRACT

A device for punching holes in a bicycle rim includes a flange extending radially from a base, the flange having a plurality of rails disposed thereon each for a puncher slidably disposed thereon. Each of the punchers has a first block and a second block respectively extending upwardly from two ends thereof and a cylinder disposed longitudinally to each of the first blocks having a shaft retractably extending therefrom which extends through the first block and has a pin member disposed on a free end thereof. Each of the second blocks has a longitudinal hole defined therethrough so that when a bicycle rim is disposed between the first blocks and the second blocks each of the pin members punches a hole through the rim.

4 Claims, 6 Drawing Sheets

DEVICE FOR PUNCHING HOLES IN A BICYCLE RIM

BACKGROUND OF THE INVENTION

1. Field of the Invention

The present invention relates to a punching device and, more particularly, to a punching device for punching holes in a bicycle rim.

2. Brief Description of the Prior Art

FIGS. 1 and 2 show a conventional device 60 for punching holes in a bicycle rim 70. The device 60 includes a first cylinder 62 and a second cylinder 64 both of which are disposed on a base 61. A sliding frame 63 slidably extending through the base 61 has a first end plate 631 extending perpendicularly from a first end thereof and a second end plate 632 extending perpendicularly from a second end thereof, wherein the first end plate 631 is connected to a first shaft 621 of the first cylinder 62 and the second end plate 632 has a clamp device 6321 disposed on a top thereof. The second cylinder 64 has a second shaft 642 retractably extending therefrom which has a pin member 646 extending longitudinally therefrom. An extending plate 643 is connected to the second shaft 642 and a block 645 is slidably disposed on the extending plate 643 wherein the pin member 646 freely extends through the block 645. A spring 648 is mounted to a casing 649 of the pin member 646 and urged between the block 645 and the second shaft 642. The block 645 has a ring member 647 disposed to a side facing the clamp device 6321 and a tube 644 is connected to the ring member 647 so that the pin member 646 extends through the tube 644. A plurality of the above mentioned devices 60 are arranged in a circle as shown in FIG. 2 and a bicycle rim 70 is disposed to a position by a robot, for example, to be clamped by the clamp devices 6321. The first cylinder 62 of each device is then actuated to extend each respective first shaft 621 so that each sliding frame 63 is moved to shift the rim 70 toward the respective pin member 646. The second shaft 642 of each of the devices 60 is then extended to depress the respective spring 648 and the tube 644 forms a recess in an inner periphery of the rim 70, and then, the pin member 646 punches a hole through a bottom defining the recess of the rim 70. An inherent shortcoming of the device 60 is that two cylinders 62, 64 have to be actuated respectively and this is time inefficient.

The present invention intends to provide a improved device for punching holes in a bicycle rim to mitigate and/or obviate the above-mentioned problem.

SUMMARY OF THE INVENTION

The present invention provides a device for punching holes in a bicycle rim and comprises a tubular base having a flange extending radially from a top thereof and the flange has a plurality of rails fixedly disposed thereon. Each of the rails has a sliding member slidably mounted thereto.

A plurality of punchers are each fixedly connected to the sliding member corresponding thereto and have a first end with a first block extending upwardly therefrom and a second end with a second block extending upwardly therefrom. A cylinder is fixedly and longitudinally connected to one of two ends of each of the first blocks and has a shaft retractably extending therefrom which extends through the first block corresponding thereto. A pin member extends from a free end of each of the shafts and each of the second blocks has a longitudinal hole defined therethrough so that when a bicycle rim is disposed between the first blocks and the second blocks, each pin member punches a hole through the rim.

It is an object of the present invention to provide a device for punching holes through a bicycle rim which needs only one cylinder for each puncher.

It is another object of the present invention to provide a device for punching holes through a bicycle rim which requires a short operation time.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
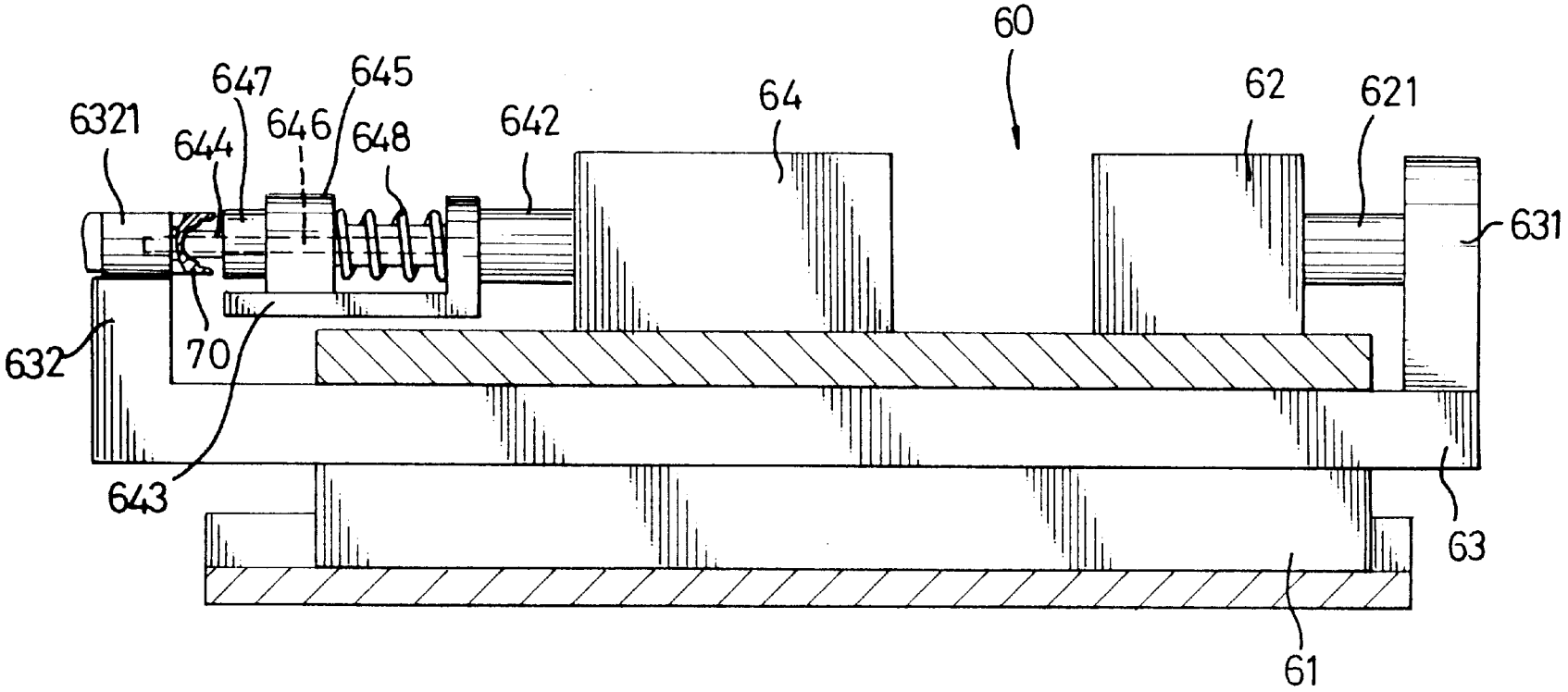
FIG. 1 PRIOR ART
FIG. 1 is a side elevational view showing a conventional device for punching holes through a bicycle rim.
Figure 2:
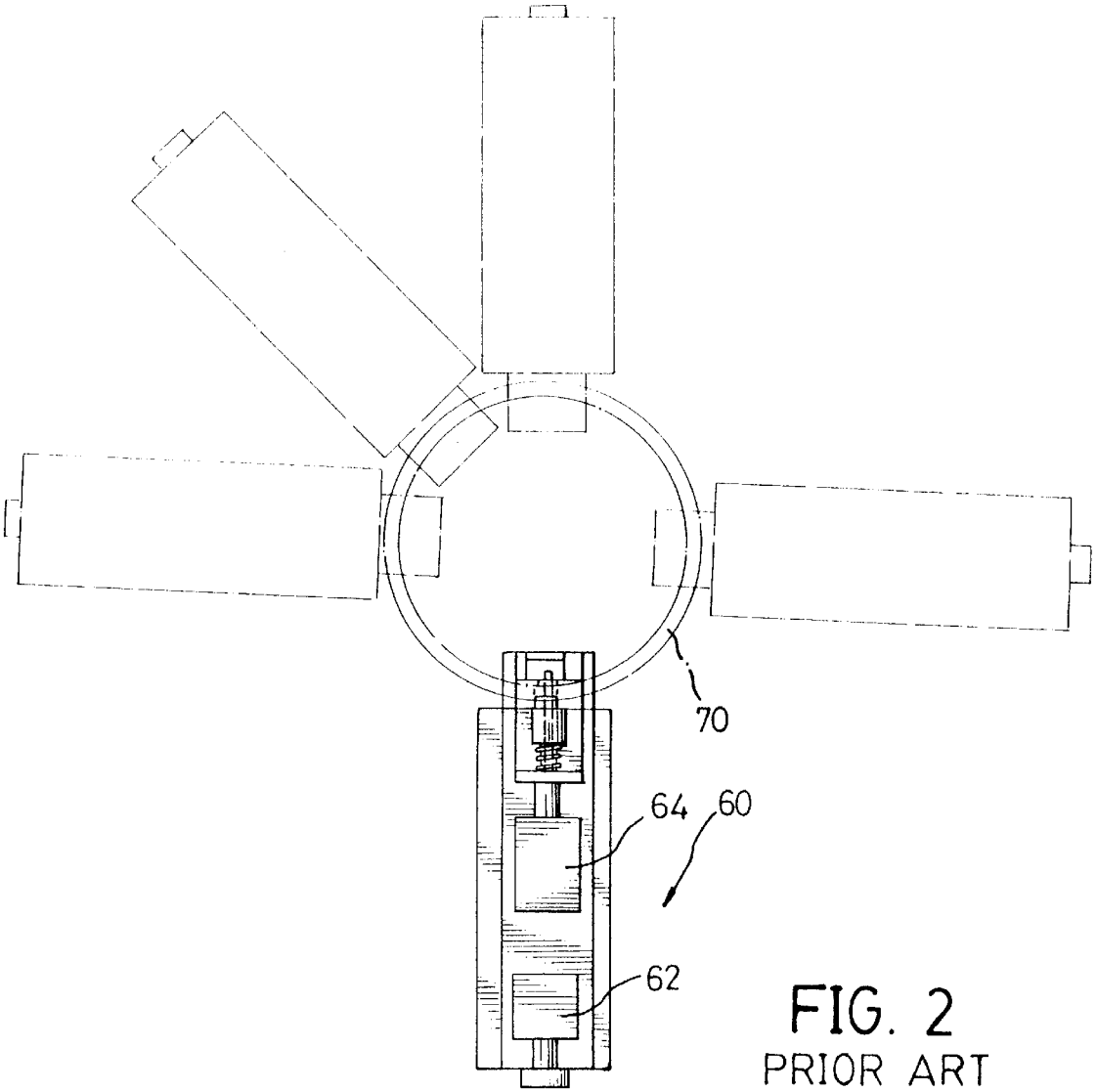
FIG. 2 PRIOR ART
FIG. 2 is a top plan view showing a plurality of conventional devices and the bicycle rim.
Figure 3:
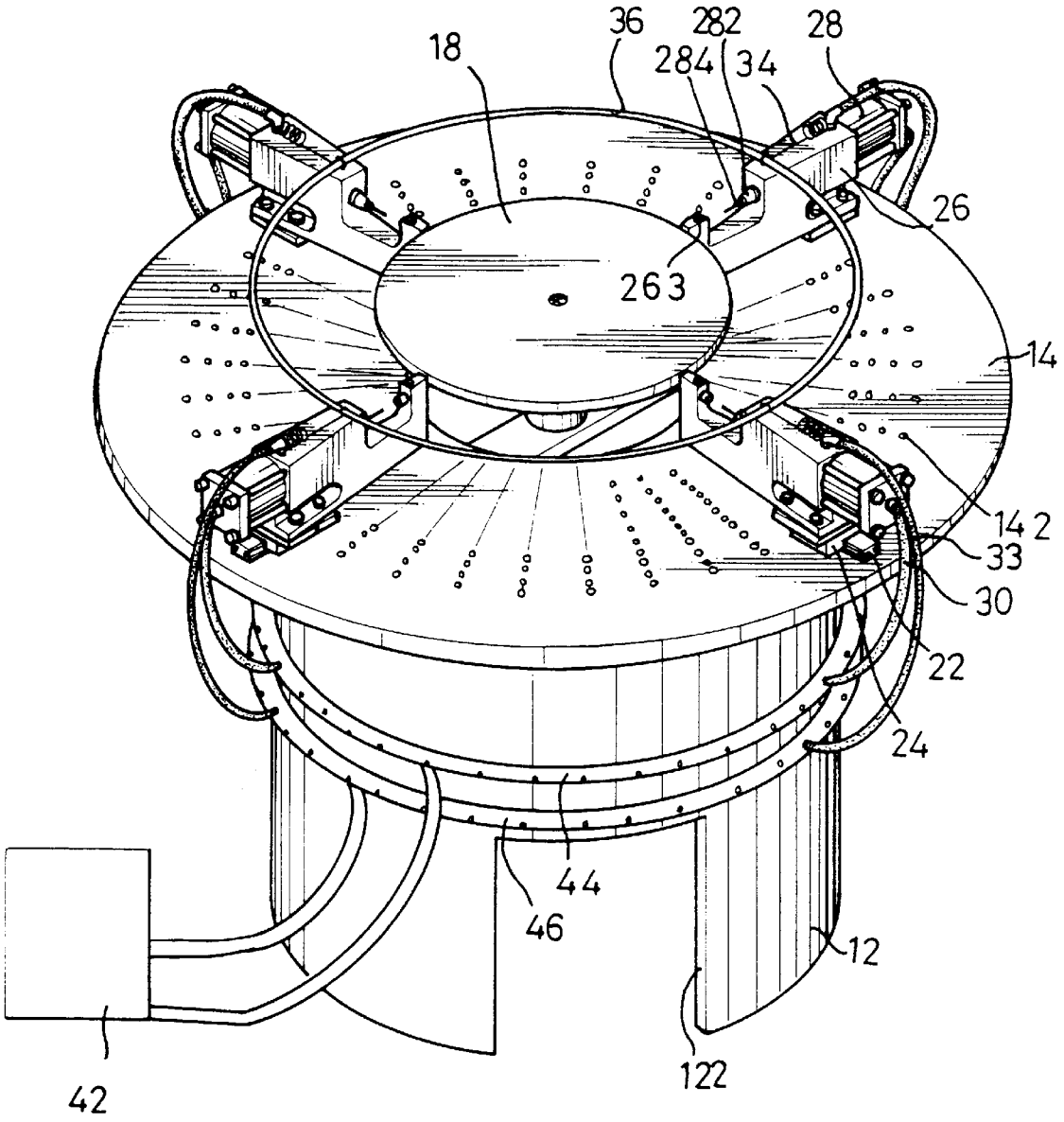
FIG. 3 is a perspective view of a device in accordance with the present invention for punching holes through a bicycle rim.
Figure 4:
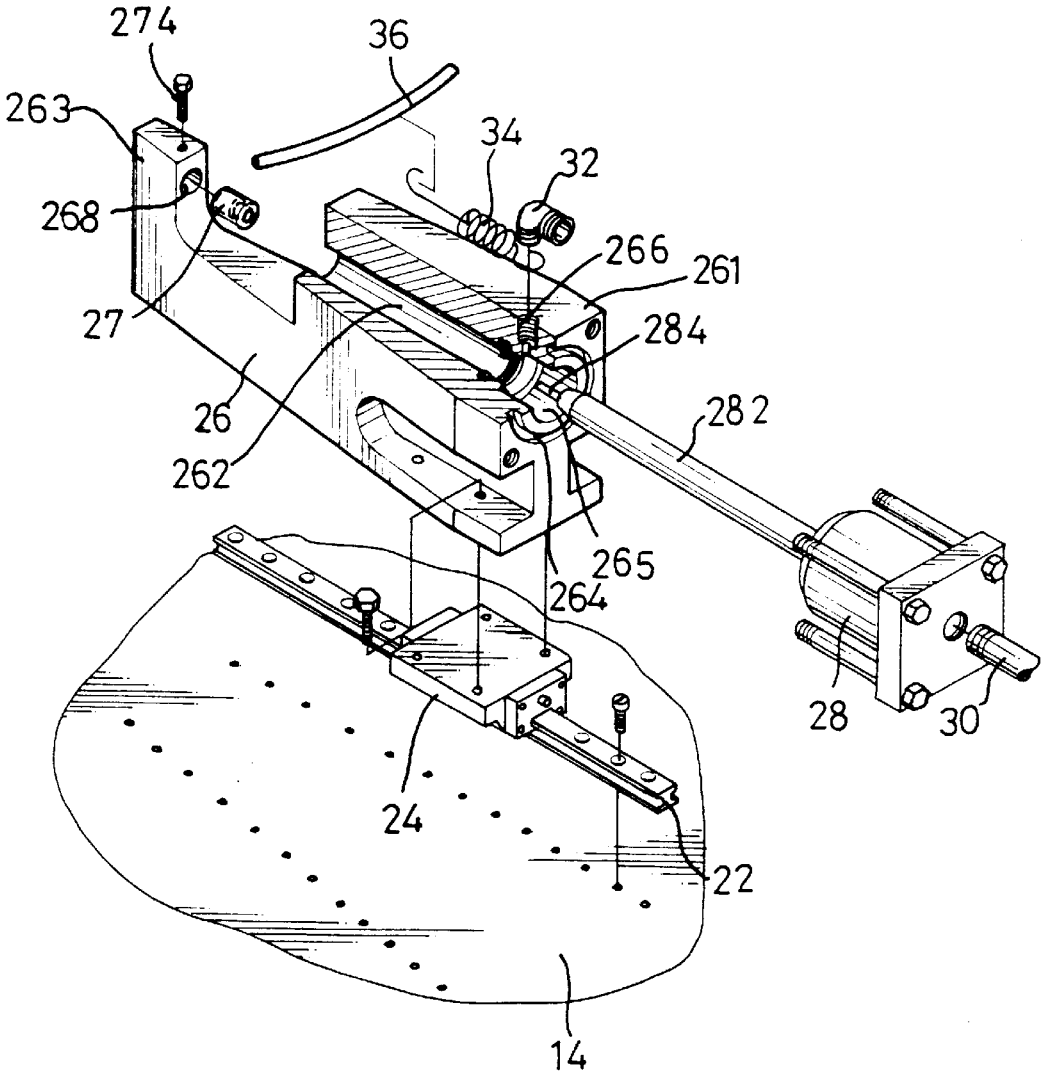
FIG. 4 is an exploded view of a puncher of the device in accordance with the present invention.

Referring to the drawings and initially to FIGS. 3 and 4, a device in accordance with the present invention for punching holes through a bicycle rim generally includes a tubular base 12 having a flange 14 extending radially from a top thereof and an opening 122 defined in a periphery thereof near a lower portion thereof. The flange 14 has a plurality of positioning holes 142 defined therethrough so that a plurality of rails 22 are fixedly connected on the flange 14 by extending bolts (not numbered) through the rails 22 and engaging with the positioning holes 142. Each of the rails 22 has a sliding member 24 slidably mounted thereto on which a puncher 26 is fixedly disposed.

The punchers 26 each have a first end with a first block 261 extending upwardly therefrom and a second end with a second block 263 extending upwardly therefrom which has a longitudinal hole 268 defined therethrough and a sleeve 27 is fixedly received in the longitudinal hole 268 by extending a bolt 274 through the second block 263 and contacting the sleeve 27. The first block 261 has a passage 262 defined longitudinally therethrough and an enlarged space 265 is defined in a first end away from the second block 263 of the first block 261 and communicates with the passage 262. An annular groove 264 is defined in the first end of the first block 261 and a screw hole 266 is defined through a top of the first block 261 and communicates with the enlarged space 265. A cylinder 28 is fixedly and longitudinally connected to the first end of the first block 261 and its casing is received in the annular groove 264. A piston member 281 from which a shaft 282 extends is slidably received in the casing. The shaft 282 extends through the passage 262 of the first block 261 and has a pin member 284 extending from a free end thereof.

Each of the cylinders 28 has a first pipe 30 connected to a free end thereof and an elbow member 32 is threadedly received in the screw hole 266 so that a second pipe 33 is connected to the elbow member 32. The first pipe 30 and the second pipe 33 are respectively connected to hoses 44, 46 mounted on the periphery of the base 12 and the hoses 44, 46 are connected to a hydraulic liquid tank 42. A spring 34 each has one end thereof connected to the elbow member 32 and the other end connected to a ring member 36.

Figure 5:
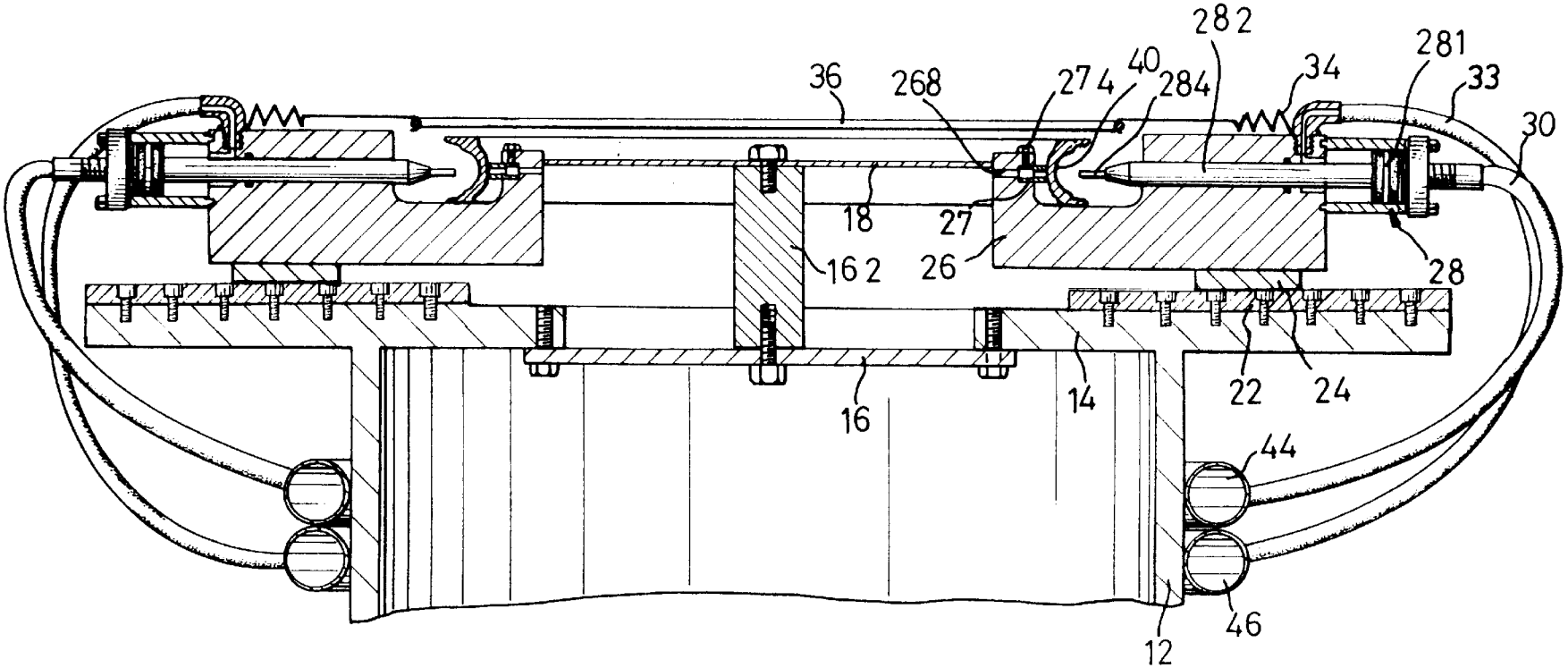
FIG. 5 is a side elevational view, partly in section, of the device with the bicycle rim disposed therein.
Figure 6:
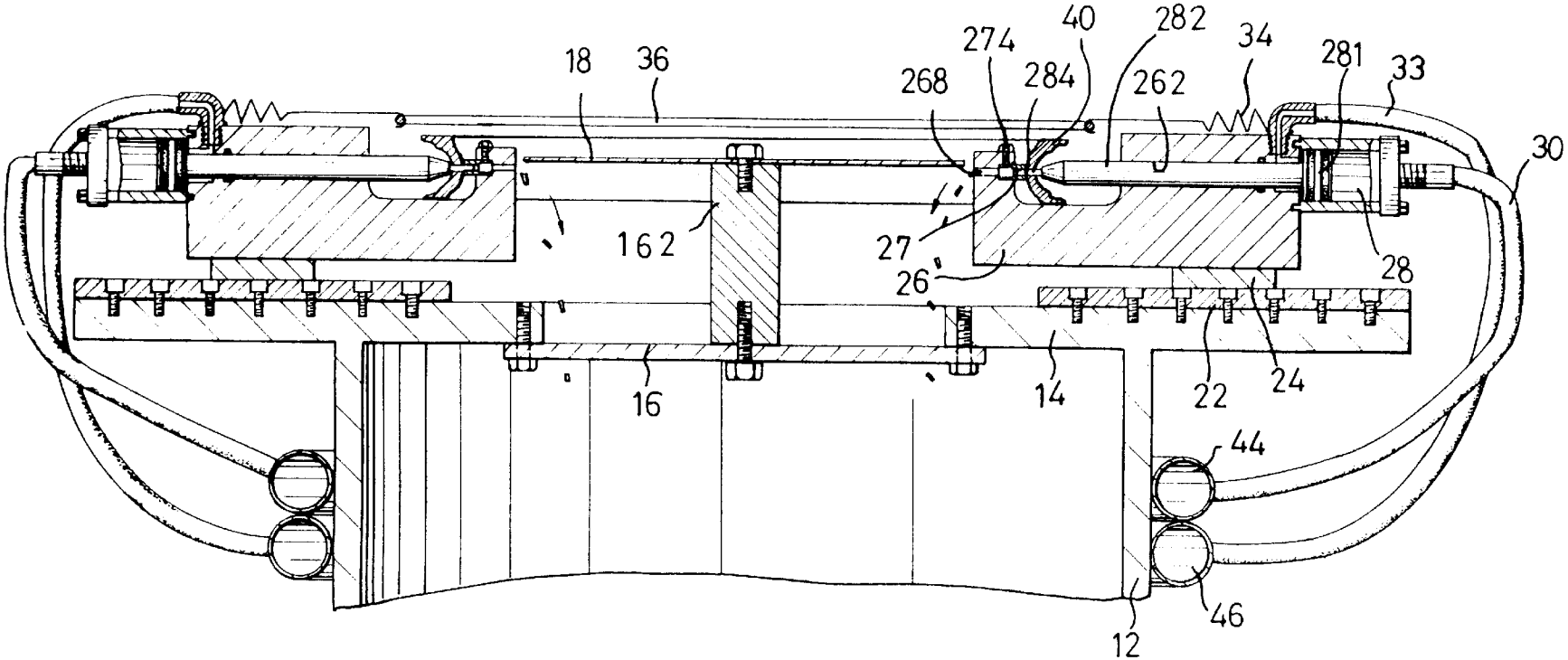
FIG. 6 is a side elevational view, partly in section, of the device when the pin members are extended through the bicycle rim.

Referring to FIGS. 5 and 6, a disk 18 is supported by a frame connected to the flange 14 and is centrally located above the base 12 so that the punchers 26 are prevented from falling into the base 12 when sliding along the rails 22 thereof by contacting the disk 18. The frame includes a plate 16 and a past 162, wherein the plate 16 is fixedly and diametrically connected between an inner periphery of the flange 14 and the post 162 extends from the plate 16 and supports the disk 18 on a top of the post 162.

A bicycle rim 40 is disposed between each of the first blocks 261 and the second blocks 263 of the punchers 26. When hydraulic liquid enters into the first pipes 30 to push the piston members 281 toward the corresponding first block 261, the shafts 282 extend. Meanwhile, the hydraulic liquid also exerts a force on the free end of each of the cylinders 28 and moves the cylinders 28 together with the punchers 26 to slide on the rails 22 outwardly with respect to the flange 14, and this movement moves the sleeve 27 in each of the second blocks 263 to contact an inner periphery of the bicycle rim 40 as shown in FIG. 5. As soon as the bicycle rim 40 contacts the sleeves 27, the pin members 284 punch holes through the bicycle rim 40 as shown in FIG. 6. When the punchers 26 move outwardly, the springs 34 are extended to limit the punchers 26 from falling from the flange 14. When hydraulic liquid enters into the second pipes 32, the shafts 282 are retracted into the passages 262 and the hydraulic liquid exerts a force to push the punchers 26 to slide toward the disk 18 and the punchers 26 are pulled by the springs 34 also to slide along the rails 22 to contact the disk 18. Therefore, the punchers 26 are prevented from falling into the base 12. The small pieces punched from the bicycle rim 40 drop from the longitudinal holes 268 of the second blocks 263 and fall to the ground so as to be manually collected through the opening 122.

Therefore, the device in accordance with the present invention requires only one cylinder 28 for each of the punchers 26 and uses only one step to actuate the cylinder 28.

Although the invention has been explained in relation to its preferred embodiment, it is to be understood that many other possible modifications and variations can be made without departing from the spirit and scope of the invention as hereinafter claimed.

What is claimed is:

1. A device for punching holes in a bicycle rim comprising:

a tubular base having a flange extending radially from a top thereof, said flange having a plurality of rails fixedly disposed thereon, each of said rails having a sliding member slidably mounted thereto;

a plurality of punchers each fixedly connected to a respective one of said sliding members and having a first end with a first block extending upwardly and a second end with a second block extending upwardly, each of said first blocks having a cylinder fixedly and longitudinally connected to a first end thereof and located away from said second block corresponding thereto, each of said cylinders having a shaft retractably extending therefrom which extends through said first block corresponding thereto, a pin member extending from a free end of each of said shafts, and each of said second blocks having a longitudinal hole defined therethrough; a ring member and a plurality of springs each having one end thereof connected to a respective one of said puncher and the other end connected to said ring member.

2. The device as claimed in claim 1 wherein each of said longitudinal holes has a sleeve fixedly received therein so as to receive said pin member corresponding thereto when said shafts extend toward said respective second blocks.

3. The device as claimed in claim 1 wherein each of said cylinders has a first pipe connected to a free end thereof and a piston member slidably received therein which is connected to said shaft corresponding thereto, and each of said first blocks has a corresponding second pipe connected to a top thereof.

4. The device as claimed in claim 1 wherein a disk is supported by a frame connected to said flange and is located centrally above said base so that said punchers are prevented from falling into the base when sliding along said rails thereof by contacting said disk.

* * * * *